US010014133B2

(12) United States Patent
Chih et al.

(10) Patent No.: US 10,014,133 B2
(45) **Date of Patent: *Jul. 3, 2018**

(54) KEYBOARD AND BACKLIGHT MODULE

(71) Applicant: DARFON ELECTRONICS CORP., Taoyuan (TW)

(72) Inventors: Shao-Chi Chih, Taoyuan (TW); Hsin-Cheng Ho, Taoyuan (TW)

(73) Assignee: DARFON ELECTRONICS CORP., Taoyuan (TW)

( * ) Notice: Subject to any disclaimer, the term of this patent is extended or adjusted under 35 U.S.C. 154(b) by 0 days.

This patent is subject to a terminal disclaimer.

(21) Appl. No.: 15/839,821

(22) Filed: Dec. 12, 2017

(65) Prior Publication Data

US 2018/0102226 A1 Apr. 12, 2018

Related U.S. Application Data

(63) Continuation of application No. 15/190,171, filed on Jun. 22, 2016, now Pat. No. 9,875,864.

(30) Foreign Application Priority Data

Aug. 21, 2015 (TW) ..... 104127278 A
Jan. 15, 2016 (TW) ..... 105101189 A

(51) Int. Cl.
*H01H 9/00* (2006.01)
*H01H 13/83* (2006.01)
*H01H 13/704* (2006.01)

(52) U.S. Cl.
CPC ..... *H01H 13/83* (2013.01); *H01H 13/704* (2013.01); *H01H 2219/044* (2013.01); *H01H 2219/06* (2013.01); *H01H 2219/062* (2013.01)

(58) Field of Classification Search
CPC ..... H10H 2219/06; H10H 2219/062; G02B 6/0055
(Continued)

(56) References Cited

U.S. PATENT DOCUMENTS 4,056,701 A * 11/1977 Weber ..... H01H 13/83 200/314
8,950,881 B2 * 2/2015 Chen ..... H01H 13/83 200/314
(Continued)

FOREIGN PATENT DOCUMENTS

CN 202307643 U 7/2012
CN 204204709 U 3/2015
(Continued)

*Primary Examiner* — Vanessa Girardi
(74) *Attorney, Agent, or Firm* — Winston Hsu

(57) ABSTRACT

A keyboard includes a base plate, key switches and a backlight module. The base plate has posts. The backlight module includes a masking plate, a light guiding plate, a light emitting unit, a reflective plate and an attaching layer. A plurality of upper through holes are formed on the masking plate. An upper attached area is defined by a periphery of each of the upper through holes. A plurality of penetrating holes are formed on the light guiding plate. A plurality of lower through holes are formed on the reflective plate. A lower attached area is defined by a periphery of each of the lower through holes. The attaching layer attaches the lower attached area with the upper attached area. The lower attached area is attached to the upper attached area via the corresponding penetrating hole, so as to block side walls of the corresponding penetrating hole.

2 Claims, 4 Drawing Sheets

(58) Field of Classification Search
USPC ..... 200/310; 362/23.03, 600, 615
See application file for complete search history.

(56) References Cited

U.S. PATENT DOCUMENTS

| | | | | |
|---|---|---|---|---|
| 9,176,272 | B2 * | 11/2015 | Wang | G06F 3/0202 |
| 2015/0332874 | A1 | 11/2015 | Brock | |

FOREIGN PATENT DOCUMENTS

| | | | |
|---|---|---|---|
| TW | M465611 | U | 11/2013 |
| TW | M523184 | U | 6/2016 |

* cited by examiner

KEYBOARD AND BACKLIGHT MODULE

CROSS REFERENCE TO RELATED APPLICATIONS

This is a continuation application of U.S. patent application Ser. No. 15/190,171, filed Jun. 22, 2016, which claims the benefit of Taiwan Patent Application No. 104127278, filed on Aug. 21, 2015 and Taiwan Patent Application No. 105101189, filed on Jan. 15, 2016, the contents of which are incorporated herein by reference.

BACKGROUND OF THE INVENTION

1. Field of the Invention

The present invention relates to a keyboard, and more particularly, to a keyboard capable of preventing leakage of light from holes on a base plate.

2. Description of the Prior Art

Recently, a keyboard has been widely used in people's daily life for inputting words, digits, characters and so on. In order to generate visual effect and enhance visibility in a dark room, a backlight module is disposed below a base of the keyboard, so as to illuminate key switches of the keyboard. In practical application, it needs penetrating holes on a light guide plate of the backlight module for pillars, such as screw bosses, melting posts and so on, on the base to pass through, or for air to flow through for heat dissipation. However, a light emitted from the backlight module will emit out of the light guide plate via the penetrating holes, resulting in leakage of light from the penetrating holes on the light guide plate. Thus, it affects appearance of products.

SUMMARY OF THE INVENTION

The present invention provides a keyboard capable of preventing leakage of light from holes on a base plate for solving above drawbacks.

According to an embodiment of the present invention, a keyboard includes a base plate, a plurality of key switches and a backlight module. The base plate has an upper surface, a lower surface and a plurality of posts protruding from the lower surface. The plurality of key switches are disposed on the upper surface. The backlight module includes a masking plate, a light guiding plate, a light emitting unit, a reflective plate and an attaching layer. The masking plate is disposed on the lower surface. A plurality of upper through holes are formed in the masking plate. An upper attached area is defined by a periphery of each of the upper through holes. The light guiding plate is disposed below the masking plate. A plurality of penetrating holes are formed in the light guiding plate and located corresponding to the plurality of upper through holes. The light emitting unit is located on a lateral side of the light guiding plate and for emitting a light into the light guiding plate. The reflective plate is disposed below the light guiding plate and for reflecting the light guided toward the reflective plate by the light guiding plate. A plurality of lower through holes are formed in the reflective plate and located corresponding to the plurality of penetrating holes. A lower attached area is defined by a periphery of each of the lower through holes. The lower attached area is attached to the upper attached area via the corresponding penetrating hole, so as to block side walls of the corresponding penetrating hole. The attaching layer is disposed between the upper attached area and the lower attached area for attaching the lower attached area with the upper attached area. A sum over a thickness of the upper attached area, a thickness of the lower attached area and a thickness of the attaching layer is smaller than a thickness of the light guiding plate. The upper attached area is a flat structure. The lower attached area includes a lower attached portion disposed in the penetrating hole. The attaching layer attaches the flat structure with the lower attached portion. The lower attached portion contacts with the corresponding post. The lower attached area further includes a lower attaching connecting portion connecting the lower attached portion and the reflective plate and being located in the penetrating hole.

According to an embodiment of the present invention, a plurality of transparent areas are formed on the masking plate, and the light guiding plate guides a part of the light to emit via the plurality of transparent areas.

In summary, the present invention utilizes by the attaching layer for attaching the upper attached area of the masking plate to the lower attached area of the reflective plate in the penetrating hole on the light guiding plate, so as to block the side walls of the penetrating holes on the light guiding plate. In such a manner, it can further prevent the light guided by the light guiding plate to emit out of the light guiding plate via the penetrating holes, so as to prevent leakage of light from the penetrating holes on the light guiding plate of the backlight module. Furthermore, the sum over the thickness of the upper attached area, the thickness of the lower attached area and the thickness of the attaching layer is smaller than the thickness of the light guiding plate. In such a manner, when the attaching layer is utilized for attaching the lower attached area to the upper attached area in the penetrating holes, the upper attached area and the attaching layer are able to be completely located within the penetrating holes, i.e., neither the upper attached area nor the attaching layer protrude from the light guiding plate, and it facilitates to reduce the whole thickness of the backlight module.

These and other objectives of the present invention will no doubt become obvious to those of ordinary skill in the art after reading the following detailed description of the preferred embodiment that is illustrated in the various figures and drawings.

DETAILED DESCRIPTION

In the following detailed description of the embodiments, reference is made to the accompanying drawings which form a part hereof, and in which is shown by way of illustration specific embodiments in which the invention may be practiced. In this regard, directional terminology, such as "top," "bottom," etc., is used with reference to the orientation of the Figure(s) being described. The components of the present invention can be positioned in a number of different orientations. As such, the directional terminology is used for purposes of illustration and is in no way limiting. On the other hand, the drawings are only schematic and the sizes of components may be exaggerated for clarity. It is to be understood that other embodiments may be utilized and structural changes may be made without departing from the scope of the present invention. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," and "installed" and variations thereof herein are used broadly and encompass direct and indirect connections and installations. Accordingly, the drawings and descriptions will be regarded as illustrative in nature and not as restrictive.

Figure 1:
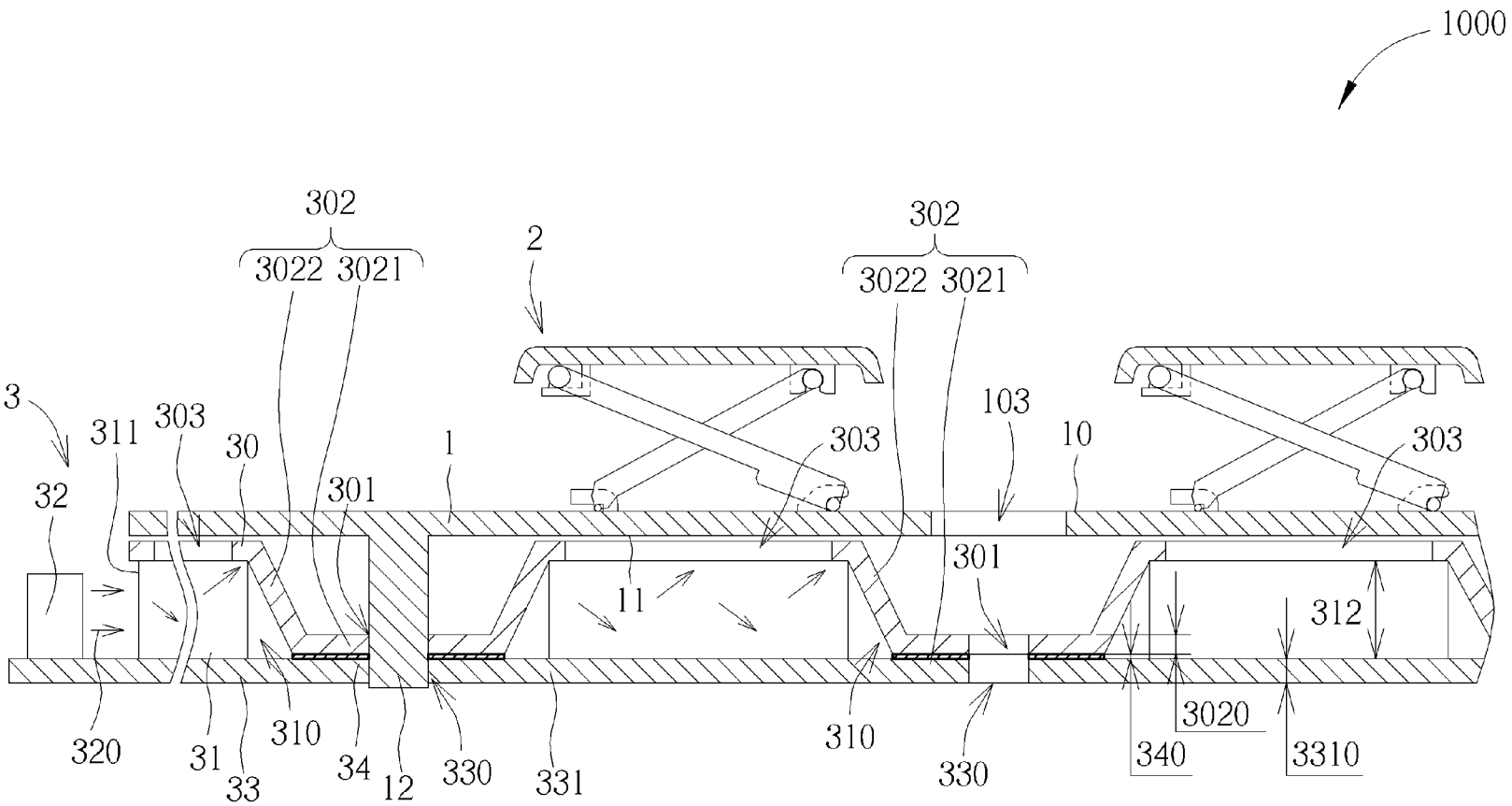
FIG. 1 is a partly sectional diagram of a keyboard according to a first embodiment of the present invention.

Please refer to FIG. 1. FIG. 1 is a partly sectional diagram of a keyboard 1000 according to a first embodiment of the present invention. As shown in FIG. 1, the keyboard 1000 includes a base plate 1, a plurality of key switches 2 and a backlight module 3. The base plate 1 has an upper surface 10 and a lower surface 11. The plurality of key switches 2 are disposed on the upper surface 10 for allowing users to input words, digits, characters and so on.

Figure 2:
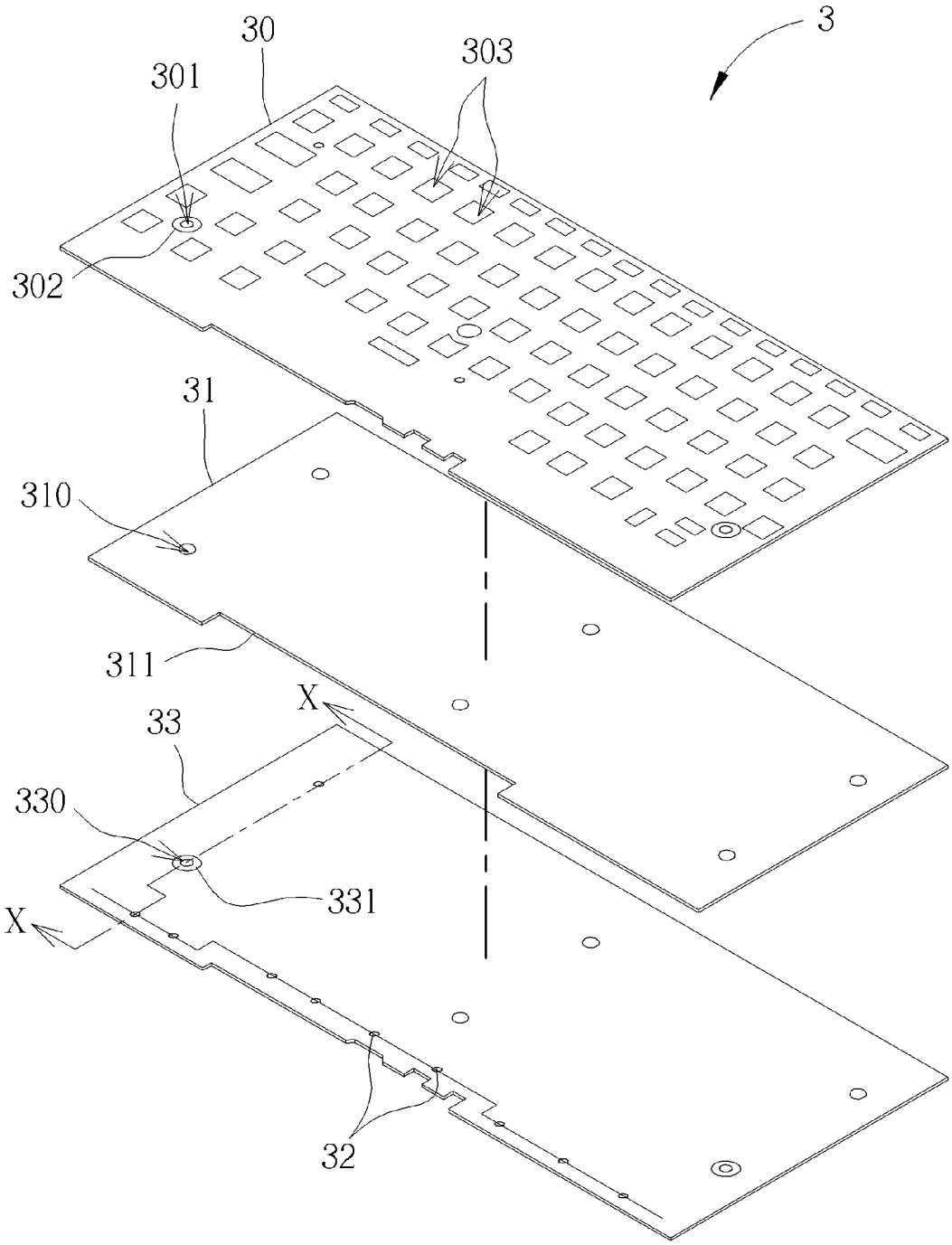
FIG. 2 is an exploded diagram of a backlight module according to the first embodiment of the present invention.

Please refer to FIG. 1 and FIG. 2. FIG. 2 is an exploded diagram of the backlight module 3 according to the first embodiment of the present invention. It should be noticed that the keyboard 1000 shown in FIG. 1 is illustrated along a section line X-X in FIG. 2. As shown in FIG. 1 and FIG. 2, the backlight module 3 includes a masking plate 30, a light guiding plate 31, a light emitting unit 32, a reflective plate 33 and an attaching layer 34. The masking plate 30 is disposed on, but not attached to, the lower surface 11 of the base plate 1, i.e., the masking plate 30 is spaced from the lower surface 11 of the base plate 1. A plurality of upper through holes 301 and a plurality of transparent areas 303 are formed on the masking plate 30. The plurality of transparent areas 303 are disposed below key caps and corresponding to each thereof. The transparent areas 303 can be window openings or transparent plastic mylars without dark ink printed thereon. An upper attached area 302 is defined by a periphery of each of the upper through holes 301. The light guiding plate 31 is disposed below the masking plate 30. A plurality of penetrating holes 310 are formed on the reflective plate 33 and located corresponding to the plurality of upper through holes 301. The light emitting unit 32 is disposed on the reflective plate 33 and located on a lateral side 311 of the light guiding plate 31. The light emitting unit 32 is used for emitting a light 320 into the light guiding plate 31, so that the light guiding plate 31 is able to guide the light 320 toward the masking plate 30. In such a manner, the light guiding plate 31 toward the masking plate 30 is able to emit out of the masking plate 30 via the plurality of transparent areas 303 for illuminating each of the key caps. In other words, the light guiding plate 31 is able to guide a part of the light 320 to project out of the masking plate 30 via the plurality of transparent areas 303, so as to illuminate the characters on each of the key caps. It should be noticed that there can be breaking holes on the base plate 1 at positions nearby where the transparent areas 303 on the masking plate 30 are corresponding, such that the light is able to pass through the breaking holes and project toward the key caps. Furthermore, the reflective plate 33 is disposed below the light guiding plate 31 and for reflecting the light 320 guided toward the reflective plate 33 by the light guiding plate 31, such that the light 320 emitted from the light emitting unit 32 is able to project toward the masking plate 30 more. Accordingly, it enhances illuminating effect of the keyboard 1000. A plurality of lower through holes 330 is formed on the reflective plate 33 and located corresponding to the plurality of penetrating holes 310, i.e., the lower through holes 330 on the reflective plate 33, the penetrating holes 310 on the light guiding plate 31 and the upper through holes 301 on the masking plate 30 are corresponding to one another. Furthermore, a plurality of breaking holes 103 are formed on the base plate 1 and located above a Central Processing Unit (CPU) of the notebook computer. Besides, the breaking holes 103 are corresponding to the lower through holes 330 on the reflective plate 33, the penetrating holes 310 on the light guiding plate 31 and the upper through holes 301 on the masking plate 30. In such a manner, it forms an air channel penetrating through and communicating with an upper surface and a lower surface of the keyboard, which facilitates air nearby the CPU to flow upwards for escaping out of an interior of the notebook computer. Accordingly, it is able to cools the CPU effectively.

A lower attached area 331 is defined by a periphery of each of the lower through holes 330, wherein a bore diameter of the lower through hole 330 is greater than a bore diameter of the upper through hole 301 and a bore diameter of the lower through hole 330, i.e., a size of the penetrating hole 310 is greater than a size of the upper through hole 301 and a size of the lower through hole 330. Accordingly, the lower attached area 331 defined by the periphery of each of the lower through holes 330 on the reflective plate 33 is able to be attached to the upper attached area 302 defined by the periphery of each of the upper through holes 301 on the masking plate 30 via the corresponding penetrating hole 310 on the light guiding plate 31, so as to block side walls of the penetrating holes 310 on the light guiding plate 31. The attaching layer 34 is disposed between the lower attached area 331 and the upper attached area 302 and for attaching the lower attached area 331 with the upper attached area 302 for fixing the lower attached area 331 with the upper attached area 302 within the corresponding penetrating hole 310. As mentioned above, the structure which the lower attached area 331 defined by the periphery of each of the lower through holes 330 on the reflective plate 33 is attached to the upper attached area 302 defined by the periphery of each of the upper through holes 301 on the masking plate 30 allows the upper attached area 302 defined by each of the upper through holes 301 on the masking plate 30 to block the light 320 into the light guiding plate 31 from emitting out of the light guiding plate 31 via the penetrating holes 310 on the light guiding plate 31, so as to prevent leakage of light via the penetrating holes 310 on the light guiding plate 31 of the backlight module 3.

It should be noticed that the base plate 1 can include a plurality of posts 12 protruding from the lower surface 11, and the posts 12 are corresponding to at least a part of the upper through holes 301, the penetrating holes 310 and the lower through holes 330. As shown in FIG. 2, when the lower attached area 331 is attached to the upper attached area 302 within the penetrating holes 310 by the attaching layer 34, the upper through hole 301 defined by the upper attached area 302 is aligned with the lower through hole 330 defined by the lower attached area 331, so as to form a channel. Accordingly, each of the posts 12 is able to be disposed through the channel, i.e, the upper through hole 301 and the lower through hole 330, to assemble with a casing (not shown in figures) below the backlight module 3.

In practical application, the post 12 can be a screw boss, a hot melting pillar and so on, but the present invention is not limited thereto. On the other hand, there is no post 12 disposed in another part of the upper through holes 301, the penetrating holes 310 and the lower through holes 330, which facilitates the air to flow through for heat dissipation.

In this embodiment, the lower attached area 331 is a flat structure, and the upper attached area 302 includes an upper attached portion 3021 and an upper attaching connecting portion 3022. The upper attached portion 3021 is disposed in the penetrating hole 310 on the light guiding plate 31, wherein the attaching layer 34 attaches the flat structure, i.e., the lower attached area 331, with the upper attached portion 3021. The upper attaching connecting portion 3022 connects the upper attached portion 3021 and the masking plate 30 and is located in the penetrating hole 310. It should be noticed that a sum over a thickness of the upper attached area 302, a thickness of the lower attached area 331 and a thickness of the attaching layer 34 is smaller than a thickness of the light guiding plate 31. In such a manner, when the lower attached area 331 is attached to the upper attached area 302 within the penetrating holes 310 by the attaching layer 34, the upper attached area 302 and the attaching layer 34 are completely located within the penetrating holes 310, i.e., neither the upper attached area 302 nor the attaching layer 34 protrude from the light guiding plate 31. Accordingly, it reduces a whole thickness of the backlight module 3. As shown in FIG. 1, a size of the upper attached area 302, i.e., a sum over a size of the upper attached portion 3021 and a size of the upper attaching connecting portion 3022, is greater than a size of the lower attached area 331, i.e., a size of the flat structure. Accordingly, when the upper attached area 302 is attached to the lower attached area 331, i.e., when the upper attached portion 3021 of the upper attached area 302 is attached to the lower attached area 331 by the attaching layer 34, the attaching layer 34 is located substantially at a position corresponding to a bottom edge of the light guiding plate 31. Furthermore, in this embodiment, the upper attached area 302 is separate from the base plate 1, so as to facilitate assembly of the base plate 1 and the backlight module 3.

Figure 3:
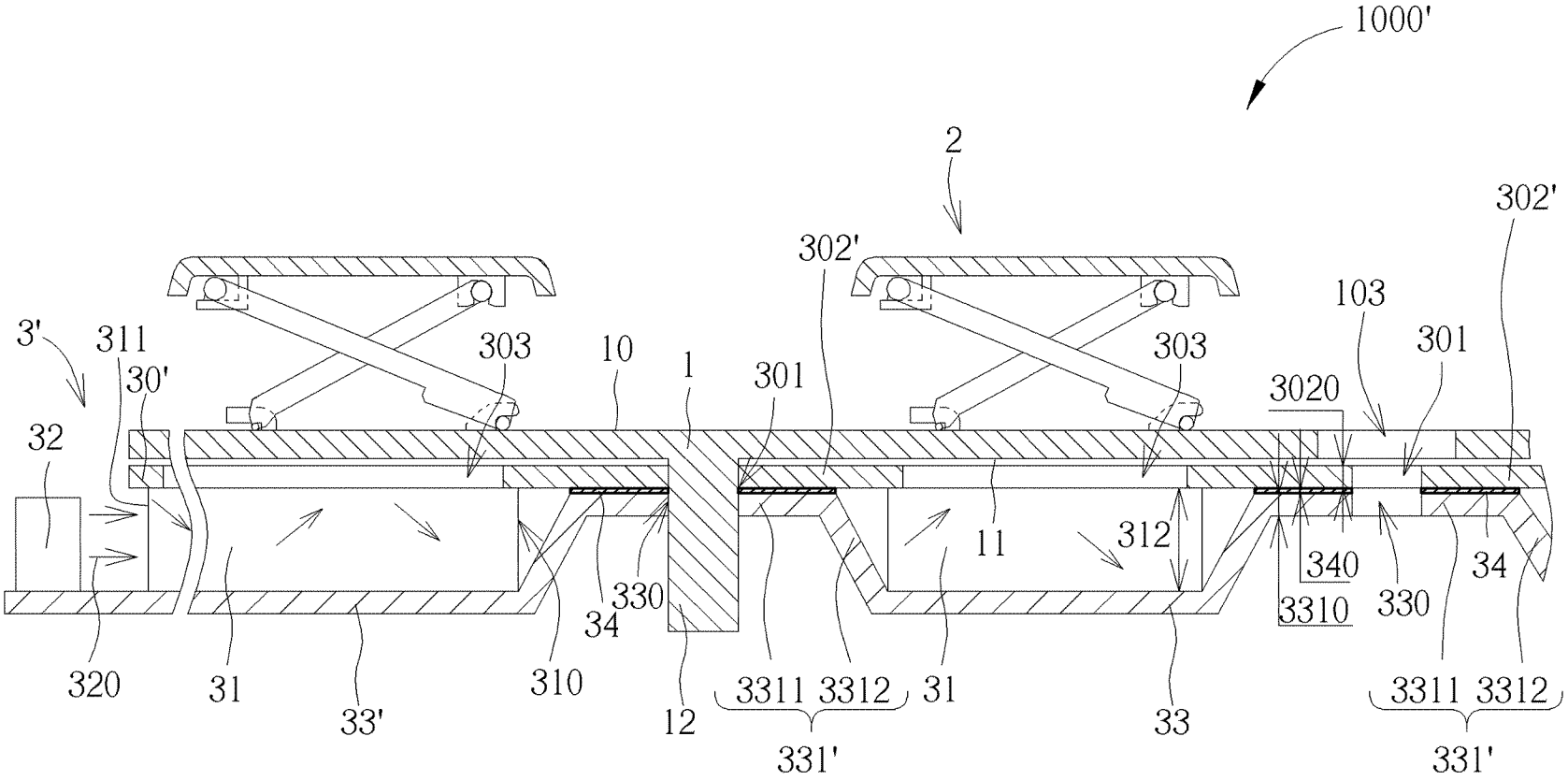
FIG. 3 is a partly sectional diagram of a keyboard according to a second embodiment of the present invention.

It should be noticed that structures of the upper attached area of the masking plate and the lower attached area of the reflective plate of the present invention are not limited to those illustrated in figures in this embodiment. For example, please refer to FIG. 3. FIG. 3 is a partly sectional diagram of a keyboard 1000' according to a second embodiment of the present invention. As shown in FIG. 3, the main difference between the keyboard 1000' and the aforesaid keyboard 1000 is that an upper attached area 302' of a masking plate 30' of a backlight module 3' of the keyboard 1000' is a flat structure, and a lower attached area 331' of a reflective plate 33' of the backlight module 3' includes a lower attached portion 3311 and a lower attaching connecting portion 3312. The lower attached portion 3311 of the lower attached area 331' is disposed in the penetrating hole 310 on the light guiding plate 31. The attaching layer 34 attaches the flat structure, i.e., the upper attached area 302', with the lower attached portion 3311, and the lower attaching connecting portion 3312 connects the lower attached portion 3311 and the reflective plate 33' and is located in the penetrating hole 310 on the light guiding plate 31. Components with denoted in this embodiment identical to those in the aforesaid embodiment have identical structures and functions, and further description is omitted herein for simplicity.

Figure 4:
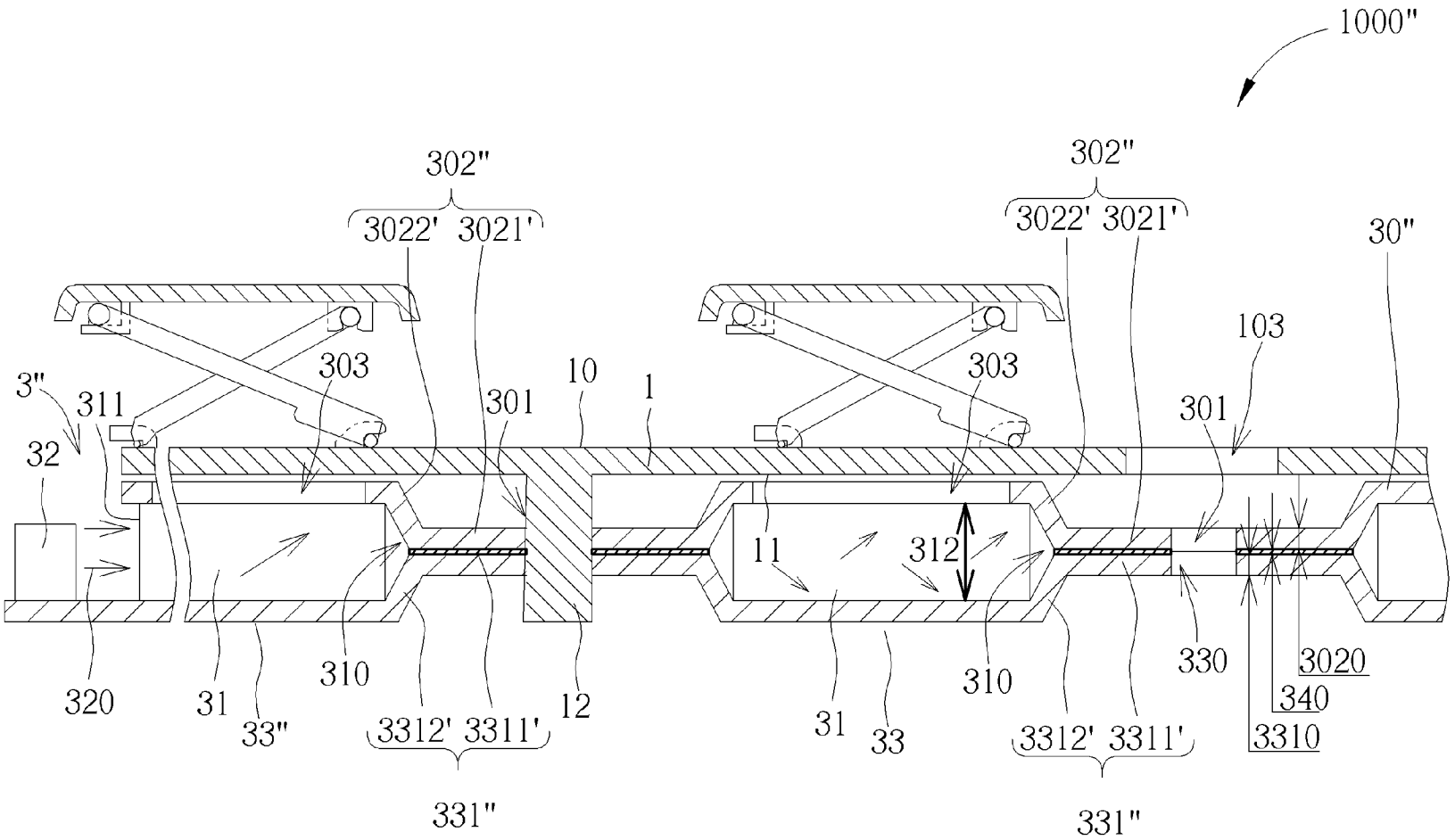
FIG. 4 is a partly sectional diagram of a keyboard according to a third embodiment of the present invention.

Please refer to FIG. 4. FIG. 4 is a partly sectional diagram of a keyboard 1000" according to a third embodiment of the present invention. As shown in FIG. 4, the main difference between the keyboard 1000' and the aforesaid keyboard 1000 is that an upper attached area 302" of a masking plate 30" of a backlight module 3" includes an upper attached portion 3021' and an upper attaching connecting portion 3022'. The upper attached portion 3021' is disposed in the penetrating hole 310 on the light guiding plate 31. The upper attaching connecting portion 3022' connects the upper attached portion 3021' and the masking plate 30' and is located in the penetrating hole 310 on the light guiding plate 31. Furthermore, a lower attached area 331" of a reflective plate 33' of the backlight module 3' includes a lower attached portion 3311' and a lower attaching connecting portion 3312'. The lower attached portion 3311' is disposed in the penetrating hole 310 on the light guiding plate 31 as well. The lower attaching connecting portion 3312' connects the lower attached portion 3311' and the reflective plate 33' and is located in the penetrating hole 310 on the light guiding plate 31. As shown in FIG. 4, a size of the upper attached area 302" of the masking plate 30" (i.e., a sum over a size of the upper attached portion 3021' and the upper attaching connecting portion 3022') is substantially equal to a size of the lower attached area 331" of the reflective plate 33" (i.e., a sum over a size of the lower attached portion 3311' and the lower attaching connecting portion 3312'). As a result, when the upper attached area 302" is attached to the lower attached area 331", i.e., when the upper attached portion 3021' of the upper attached area 302" is attached to the lower attached portion 3311' of the lower attached area 331' by the attaching layer 34, the attaching layer 34 is located substantially at a position corresponding to half of the thickness of the light guiding plate 34. Components with denoted in this embodiment identical to those in the aforesaid embodiment have identical structures and functions, and further description is omitted herein for simplicity.

Compared to the prior art, the present invention utilizes by the attaching layer for attaching the upper attached area of the masking plate to the lower attached area of the reflective plate in the penetrating hole on the light guiding plate, so as to block the side walls of the penetrating holes on the light guiding plate. In such a manner, it can further prevent the light guided by the light guiding plate to emit out of the light guiding plate via the penetrating holes, so as to prevent leakage of light from the penetrating holes on the light guiding plate of the backlight module. Furthermore, the sum over the thickness of the upper attached area, the thickness of the lower attached area and the thickness of the attaching layer is smaller than the thickness of the light guiding plate. In such a manner, when the attaching layer is utilized for attaching the lower attached area to the upper attached area in the penetrating holes, the upper attached area and the attaching layer are able to be completely located within the penetrating holes, i.e., neither the upper attached area nor the attaching layer protrude from the light guiding plate, and it facilitates to reduce the whole thickness of the backlight module.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A keyboard, comprising:

a base plate having an upper surface, a lower surface and a plurality of posts protruding from the lower surface;

a plurality of key switches disposed on the upper surface; and a backlight module, comprising:

a masking plate disposed on the lower surface, a plurality of upper through holes being formed in the masking plate, an upper attached area being defined by a periphery of each of the upper through holes;

a light guiding plate disposed below the masking plate, a plurality of penetrating holes being formed in the light guiding plate and located corresponding to the plurality of upper through holes;

a light emitting unit located on a lateral side of the light guiding plate and for emitting a light into the light guiding plate;

a reflective plate disposed below the light guiding plate and for reflecting the light guided toward the reflective plate by the light guiding plate, a plurality of lower through holes being formed in the reflective plate and located corresponding to the plurality of penetrating holes, a lower attached area being defined by a periphery of each of the lower through holes, and the lower attached area being attached to the upper attached area via the corresponding penetrating hole, so as to block side walls of the corresponding penetrating hole; and an attaching layer disposed between the upper attached area and the lower attached area for attaching the lower attached area with the upper attached area;

wherein a sum over a thickness of the upper attached area, a thickness of the lower attached area and a thickness of the attaching layer is smaller than a thickness of the light guiding plate, the upper attached area is a flat structure, and the lower attached area comprises:

a lower attached portion disposed in the penetrating hole, the attaching layer attaching the flat structure with the lower attached portion, and the lower attached portion contacting with the corresponding post; and a lower attaching connecting portion connecting the lower attached portion and the reflective plate and being located in the penetrating hole.

2. The keyboard of claim 1, wherein a plurality of transparent areas are formed on the masking plate, and the light guiding plate guides a part of the light to emit via the plurality of transparent areas.

* * * * *